United States Patent [19]

Toma et al.

[11] Patent Number: 4,943,819

[45] Date of Patent: Jul. 24, 1990

[54] IMAGE HOLDING MEMBER AND IMAGE FORMING DEVICE

[75] Inventors: Hitoshi Toma, Kawasaki; Masafumi Hisamura, Toride; Shigemori Tanaka, Kawasaki, all of Japan

[73] Assignee: Canon Kabushiki Kaisha, Tokyo, Japan

[21] Appl. No.: 408,232

[22] Filed: Sep. 18, 1989

[30] Foreign Application Priority Data

Sep. 20, 1988 [JP] Japan ..... 63-233471
Sep. 20, 1988 [JP] Japan ..... 63-233472
Sep. 20, 1988 [JP] Japan ..... 63-233474

[51] Int. Cl.[5] ..... G03G 13/22; G03G 5/04
[52] U.S. Cl. ..... 346/160.1; 430/97
[58] Field of Search ..... 346/153.1, 160.1, 160; 430/56, 97; 355/251

[56] References Cited

U.S. PATENT DOCUMENTS 4,259,425 3/1981 Serlin ..... 430/97
4,374,895 2/1983 Yasuda et al. ..... 346/153.1 X
4,547,787 10/1985 Kaneko et al. ..... 346/153.1 X
4,693,951 9/1987 Takasu et al. ..... 346/153.1 X

FOREIGN PATENT DOCUMENTS 51-046707 4/1976 Japan .

*Primary Examiner*—Donald A. Griffin
*Attorney, Agent, or Firm*—Fitzpatrick, Cella, Harper & Scinto

[57] ABSTRACT

The present invention is an image holding member for holding particulate dry process developer by electrical adsorption force, having from the side holding the dry process developer, a dielectric layer, a diffusion reflection layer having reflective fine particles dispersed in a resin and an electroconductive layer. The electrical resistance of the diffusion reflection layer is made smaller than that of the dielectric layer, and/or the ten-point average roughness of the dielectric layer is made 0.1 μm to 5.0 μm. Also, it is an image forming device by use of the above image holding member, having from the side holding the dry process developer, the above image holding member, driving means for the image holding member, recording electrodes arranged in the direction crossing the moving direction of the image holding member and electrically insulated from each other, means for feeding an electroconductive developer between the image holding member and the recording electrodes, and means for applying electrical signals to the recording electrodes.

14 Claims, 4 Drawing Sheets

IMAGE HOLDING MEMBER AND IMAGE FORMING DEVICE

BACKGROUND OF THE INVENTION

1. Field of the Invention

This invention relates to a so called magnestylus system recording display device which record and display images by attaching a magnetic electroconductive developer onto an image holding member by electrical adsorption force.

2. Related Background Art

In the prior art as the recording display device which enables highly precise and large picture face display simply and inexpensively, there has been proposed the so called magnestylus system (see, for example, Japanese Patent Publication No. 51-46707). Its principle is, as shown in FIG. 5 thereof, to rotate a columnar magnet 2 within a nonmagnetic cylinder 3, convey a colored magnetic electroconductive developer 1 through its magnetic force on the nonmagnetic cylinder 3 and feed the toner onto the needle-like recording electrodes 4 arranged densely along the axis direction on the nonmagnetic cylinder 3.

And, a voltage is applied according to image information between the electroconductive layer 7 of an image holding member 5 comprising a recording layer 6 on the surface side and an electroconductive layer 7 on the backside nd the recording electrodes 4, to form an image by attaching the magnetic developer 1 onto the image holding member 5 only at the portion where voltage is applied.

However, in the case of the prior art as described above, performances with respect to high contrast, high life, stability under various environments, high reliability, etc. have been unsatisfactory.

Accordingly, as the method for enhancing the contrast of the image holding member 5, various methods as shown below have been considered:

(1) a method in which diffusion reflection is effected by making the light reflecting surface uneven;

(2) a method in which an anodically oxidized film of aluminum is used (see Japanese Patent Publication No. 51-46707);

(3) a method in which a diffusion reflection layer having fine particles dispersed in a binder resin is laminated on an electroconductive layer 7;

(4) a method in which a diffusion reflection layer having fine particles dispersed in a binder resin and further a dielectric layer are laminated on an electroconductive layer 7.

However, according to the method of (1), the magnetic electroconductive developer is trapped at the concavities to bring about lowering in contrast.

According to the method of (2), cracks will be generated during anodic oxidatiOn, whereby voltage leak is liable to occur. Also, the surface becomes uneven to give rise to similar troubles as in the method of (1). Further, whiteness of the anodically oxidized film is low to make no sufficient contrast. Further, when there is a change in environment, voltage leak will frequently occur, whereby various problems will emerge such that the density of recording or display is lowered, failing to make sufficient contrast.

On the other hand, according to the method of (3), although the whiteness at the initial stage is excellent in contrast, the magnetic electroconductive developer is trapped during repeated uses by the fine voids generated by dispersing fine particles to bring about lowering in contrast.

Also, adsorption and desorption of water are marked at the fine void portions remaining when the temperature, the humidity, etc. change, whereby electrical resistance will be greatly changed. For this reason, the electrical adsorption force of the developer changes depending on the environment, whereby there ensues the problem that the change in contrast of image is great. In other works, under highly humid conditions, as the result of adsorption of humidity which progresses remarkably through fine gaps, the electrical resistance is greatly lowered to make the adsorption force of the magnetic electroconductive developer, resulting in lowering of contrast.

According to the method of (4), although whiteness at the initial stage is high and the environmental stability is excellent, whiteness still tends to be lowered slightly during repeated uses.

SUMMARY OF THE INVENTION

The present invention has been accomplished in order to solve the tasks of the prior art as described above, and its object is to provide a recording display device, in which the so called magnestylus system which records an image on an image holding member by electrical adsorption of a magnetic electroconductive developer, exhibiting high contrast as well as excellent recording or displaying characteristics. The device further has little environmental dependency and excellent durability, and an image holding member to be used for such device.

The present invention accomplishing the above object is an image holding member for holding particulate dry process developer by electrical adsorption force, having from the side holding the dry process developer, a dielectric layer, a diffusion reflection layer having reflective fine particles dispersed in a resin and an electroconductive layer, wherein the electrical resistance of the diffusion reflection layer is made smaller than that of the dielectric layer, and/or the ten-point average roughness of the dielectric layer is made 0.1 μm to 5.0 μm. Also, it is an image forming device by use of the above image holding member, having from the side holding the dry process developer, the above image holding member, a driving means for the image holding member, recording electrodes arranged in the direction crossing the moving direction of the image holding member and electrical insulated from each other, means for feeding an electroconductive developer between the image holding member and the recording electrodes, and means for applying electrical signals on the recording electrodes.

DESCRIPTION OF THE PREFERRED EMBODIMENTS

Figure 1A:
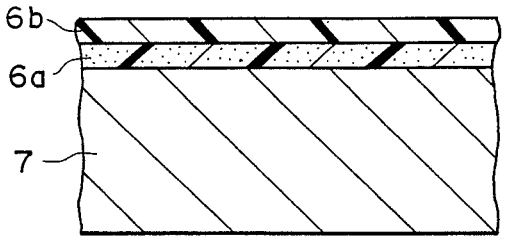
FIG. 1 A and FIG. 1 B are schematic sectional views showing the image holding member of the recording display device according to an example of the present invention.

In the following, the present invention is described by referring to Examples shown in the drawings.

Figure 1B:
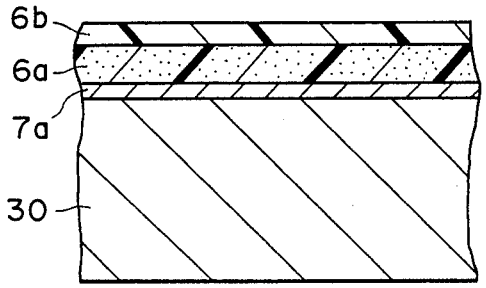

To illustrate the constitution of the model of the image holding member in the present invention, it can be as shown in FIG. 1 A and FIG. 1 B. Here, FIG. 1 A shows a structure having a diffusion reflection layer 6a laminated on one surface of an electroconductive support 7 as the electroconductive layer, while FIG. 1 B shows a structure having a diffusion reflection layer 6a laminated through an electroconductive layer 7a on one surface of the support 30. And, in either example, on the reflection layer 6a is laminated a dielectric layer 6b comprising primarily a resin.

The surface roughness of the dielectric layer 6b in terms of the ten-point average roughness as a measurement distance of 2.5 mm is set at 0.1 μm to 5.0 μm, more desirably 0.1 μm to 3.5 μm. For formation with control of the surface roughness, there may be employed various methods such as control of the dispersed state of the reflective fine particles dispersed in the diffusion reflection layer, addition of coarse particles, control of flowability during preparation, replica according to forms or roughening of the surface layer, etc. As the measuring instrument, the surface roughness meter manufactured by Taylor Hobson, the universal surface shape measuring instrument "Se-3c" manufactured by Kosaka Kenkyusho can be used.

The recording/displaying function by adsorption of magnetic electroconductive developer in the present invention is due to the charges induced by electrical field into the diffusion reflection layer 6a, the dielectric layer 6b, and therefore necessary conditions are that the layer between the diffusion reflection layer 6a and the dielectric layer 6b should have sufficient electrical resistance to not easily become under conduction state, or that substantial potential is created during charging to function so as to give rise to sufficient contrast.

Accordingly, the state of the image holding member 5 to be functional may include some factors depending on the use conditions, but when high contrast as in the present invention is intended, it is necessary to maintain 50% or higher of the initial charging voltage at 100 m.sec. or more after charging, and therefore it is preferable to set the resistivity between the diffusion reflection layer 6a and the dielectric layer 6b at $10^{12}$ Ω·cm or higher. When higher contrast is, the resistivity between the diffusion reflection layer should be preferably $10^{13}$ Ω·cm or higher. The electrical resistance of the diffusion reflection layer 6a is set at a value smaller than that of the dielectric layer 6b.

In the recording display device of the present invention, its display characteristics are proportional to the charge amount generated in the dielectric layer 6b, and therefore, although slightly related also to the coloration degree of the magnetic electroconductive developer, as a general rule, should desirably satisfy the following relationship in order to obtain sufficient contrast, when the film thickness between the dielectric layers 6b is made t, the voltage applied when forming display is made V:

$$V > 15(V/\mu m) > t(\mu m)$$

Further, for obtaining higher contrast, the relationship may be preferably:

$$V > 20(V/\mu m) > t(\mu m).$$

In view of matching with the driving circuit, since a voltage of about 100 V or less can be relatively easily outputted, the film thickness of the dielectric layer may be practically 7 μm or less, desirably 5 μm or less.

As the resin for forming said dielectric layer 6b, for example, there may be included thermoplastic resins as represented by polyester, acrylic resin, polyolefin, polyacetal, polyamide, polystyrene, halogen containing resin, silicone resin, polyether, polycarbonate, vinyl acetate resin, fibrin type resin, and copolymers of these, or thermosetting resins as represented by homopolymers or copolymers of phenol resin, xylene resin, petroleum resin, urea resin, melamine resin, unsaturated polyester, alkyd resin, epoxy resin, silicone resin, furan resin, etc., and these can be also used in a mixture.

Also, into these resins, ion electroconductive substances, ion electroconductive polymers, electron electroconductive substances, electron electroconductive polymers, etc. can be also added to lower electrical resistance.

The diffusion reflection layer 6a comprises reflective fine particles of, for example, organic resin powder such as styrene resin powder, silicone resin, halogenated olefin resin powder (e.g. polyethylene powder, polytetrafluoroethylene powder), acrylic resin powder, phenol resin powder, melamine resin powder, etc., or metal oxide such as titanium oxide, magnesium oxide, calcium oxide, barium oxide, zinc oxide, tin oxide, antimony oxide, indium oxide, etc., metal sulfate such as barium sulfate, magnesium sulfate, calcium sulfate, etc., metal carbonate such as barium carbonate, magnesium carbonate, calcium carbonate, etc. dispersed in, for example, a single or a mixed resin such as a thermoplastic resin as represented by polyester, acrylic resin, polyolefin, polyacetal, polyamide, polystyrene, halogen containing resin, silicone resin, polyether, polycarbonate, vinyl acetate resin, fibrin type resin and copolymers of these, or a thermosetting resin as represented by homopolymers or copolymers of phenol resin, xylene resin, petroleum resin, urea resin, melamine resin, unsaturated, polyester, alkyd resin, epoxy resin, silicone resin, furan resin, etc.

In such recording or displaying method, whiteness has been hitherto insufficient to give no necessary contrast, but in the present invention, since the diffusion reflection layer 6a is constituted of the binder resin and the reflective fine particles dispersed therein, whiteness of 60% or higher can be obtained to give sufficient contrast.

Also, in the recording display device, since little dependency of the contrast on the angle vision, namely excellent reflection reflectivity is required, the diffusion reflective light component is required to be made sufficiently great.

There are several methods for defining the diffusion reflectivity, but in the present invention, for its simplicity and practicability, it is defined by use of the whiteness based on the following from the reflection density by a Macbeth densitometer or a product of the same function.

Whiteness = [(1.44 - reflection density)/1.44

-continued

| | |
|---|---|
| | +0.04)] × 100 |
| Whiteness 100: | reflection density ≦ 0.04 substantially all members expressed it as pure white in the panel test) |
| Whiteness 0: | reflection density ≧ 1.44 (substantially all members expressed it as black; and also the state where no contrast can be taken at all) |

On the basis of such definition of whiteness, the contrast of recording or displaying can be defined as the difference between the whiteness as the image holding member 5 and the whiteness of the recording or displaying portion. Therefore, lowering in whiteness of the image holding member 5 leads necessarily to lowering in contrast to become insufficient as recording or displaying. Also, according to the studies, it has been found that the effect of the present invention will not be impaired, even if an intermediate layer for enhancing adhesiveness may be provided in the intermediate between the electroconductive layers 7, *7a* for prevention of peel-off of the diffusion reflection layer *6a*. Also, the electroconductive layers 7, *7a* are under electroconductive state easily with a layer having sufficiently small electrical resistance. In other words, it is a layer which functions so as to give rise to no substantial potential during charging. Accordingly, the state to be functioned as the electroconductive layer 7, *7a*, although there may be some factors depending on the use conditions, when high contrast is desired as in the present invention, sufficient electroconduction state may be said to be obtained if decayed after charging to 1/10 of the initial charging potential at 100 m.sec. or less, and therefore in the present Example, resistivity of the electroconductive layers 7, *7a* is set at about $10^{12}$ Ω·cm or less.

When more rapid image display is intended, decay after charging to 1/10 of the initial charging potential at 1 m.sec. is required, and therefore the resistivity of electroconductive layers 7, *7a* should be desirably $10^{10}$ Ω·cm or less.

The material for constituting the electroconductive layers 7, *7a* may be a single material or a composite material of an electroconductive metal such as aluminum, iron, gold, tin, zinc, etc., an electroconductive inorganic compound such as carbon, tin oxide, indium oxide, antimony oxide, etc., or one comprising the above electroconductive substance in the form of powder in a continuous phase of a polymer, etc. Particularly, for enhancing the contrast as recording or displaying, an electroconductive layer with little adsorption and excellent in light reflectivity is desirable.

Next, the magnetic electroconductive developer, which is not a condition limiting the present invention, is constituted primarily of a binder, electroconductive powder, magnetic material, and further various dyes and pigments as the colorant, if necessary. As the binder, the binder resin as described above may be used, generally in an amount of 15 to 60% by weight.

As the electroconductive powder, fine powder of electroconductive carbon, various electroconductive metals, fine powder of electroconductive oxide such as zinc oxide, tin oxide, indium oxide, antimony oxide, etc. may be used, generally in an amount of 2 to 30% by weight.

As the magnetic material, ferric oxide, etc. may be used in an amount of 20 to 80% by weight.

Further, the colorant used if necessary may include dyes or pigments, typically various phthalocyanines, Malachite Green, in an amount of 15 to 20% by weight.

By mixing uniformly the various constituent components as described above by heating to about 100 ° to 300° C., followed by cooling, and crushing the mixture into fine powder, and further removing powder with unnecessary particle size by classification, if desired, the objective magnetic electroconductive developer can be obtained. This developer has generally an average particle size of about 5 to 20 μm, and one having a resistivity in the range of $10^{13}$ to $10^{9}$ Ω·cm at an application voltage of 100 V or lower may be used.

Figure 2:
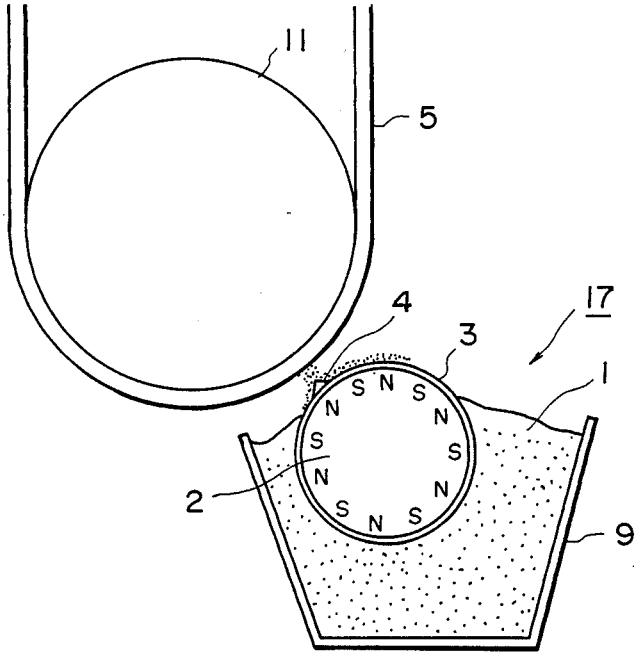
FIG. 2 is a longitudinal sectional view of the pertinent constitution of the recording display device in which the image holding device in FIG. 1 is used.
Figure 3:
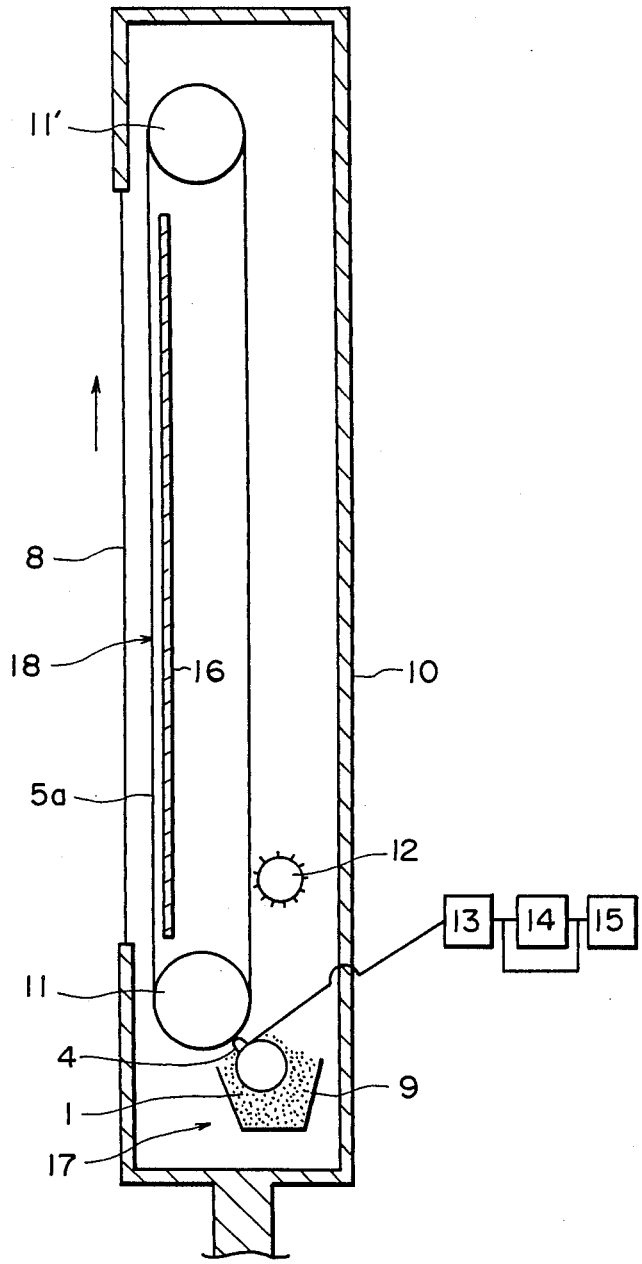
FIG. 3 is a longitudinal sectional view showing the whole constitution of the device in FIG. 2.

In the following, the present invention is described in more detail by referring to Examples and Comparative examples. FIG. 2 and FIG. 3 show specific constitutions of the recording display device.

Numeral 5 is an image holding or bearing member formed as an endless belt, which is constituted of the electroconductive support 7 as the electroconductive layer as described above and the diffusion reflection layer 6. The image holding member 5 may be also shaped an a belt which is not endless. The image holding member 5 is hanged over a pair of rollers 11, 11' arranged as opposed up and down to each other, supported flat and movable at the display portion 18 by the back plate 16 and the rollers 11, 11', and is moved in the arrowhead direction during image formation. At the position lowest of the circulating path of the image holding member 5, namely at the position confronting the roller 11, an image forming means 17 which attaches the magnetic electroconductive developer 1 as the displaying substance onto the image holding member 5 according to the display information to form a display image thereon is arranged. The magnetic electroconductive developer 1 is loused in a vessel 9.

The information obtained from an original or manuscript reading device 15 by the above image forming means 17 is applied through the memory device 14 by the recording controlling section 13 as electrical signals onto the recording electrode 4. Numeral 8 shows transparent plate, 12 a cleaning member and 18 a display portion.

As the cleaning member 12, blade cleaning, fur cleaning, suction cleaning, magnetic brush cleaning, brush cleaning, etc. can be provided. As the cleaning system, the method in which charges induced on the image holding member surface are electrically removed through the cleaning member is more effective. For example, the method in which magnets are arranged adjacent to the image holding surface, and the electroconductive colored magnetic fine powder is interposed to be earthed, or the method by use of an electroconductive brush may be effectively used.

On the other hand, to introduce general process conditions of the recording display device of the present invention, first, as the rotatory magnet 2, one consisting of 6 to 50 poles of 500 to 2000 Gauss is used by rotating at a rotational number of about 300 to 7000 rpm. As the nonmagnetic cylinder 3, a nonmagnetic metal such as aluminum, stainless steel, or a molded product of a single substance or a composite material of plastic or various inorganic oxides is used, and this may be used either with rotation or under the state not rotated. As the recording electrode 4, an application voltage of 10 to 100 V is used at an electrode width of 0.1 to 1 mm and an electrode distance of 0.1 to 1 μm. The moving speed of the image holding member 5 is set at 50 to 700 m/sec. and the distance from the electrode 4 at about 50 to 500 μm.

The above image holding member 5 was prepared as follows. First, into 30 parts by weight of a polyester resin which is a polycondensate of terephthalic acid and ethylene glycol, 30 parts by weight of fine particles of tin oxide with an average particle size of 0.5 μm were melted and dispersed at 200° C., and the dispersed product was extruded through a T-type die into a film to be heat laminated onto one surface of an aluminum foil constituting a 50 μm thick electroconductive layer, to provide a white film with a film thickness of 30μ thereon. Then, by pressurizing by means of a satin-embossed roller controlled to a temperature of 200° C. the roughness of the surface of the white film was made 1.5 μm. The diffusion reflection layer was found to have a resistivity of $10^9$ Ω·cm (25° C./50% RH).

Next, a coating material with a viscosity of 10 cps comprising 10 wt. % of a thermosetting phenol resin (number average molecular weight 500) and 90 wt. % of methyl ethyl ketone was coated by a reverse roller coater under the conditions of a coating speed of 4 m/min. and a gap of 10 μm, dried at 140° C. for 5 minutes to provide a dielectric layer with a film thickness of 1 μm on the diffusion reflection layer of the previous white film, thus providing an image holding member with surface roughness of 1.2 μm.

Next, the action of the recording display device of the above constitution is to be described.

The magnetic electroconductive developer used consisted of 30 parts by weight of a bisphenol A type epoxy resin, 10 parts by weight of an electroconductive carbon and 60 parts by weight of ferric oxide, and has an average article size of 10 μm and a resistivity of $10^6$ Ω·cm (100 V application).

The rotatory magnet 2 consisted of 16 poles of 900 Gauss, having an outer diameter of 36 ϕ, and was rotated in the opposite direction to the moving direction of the image holding member 5 at 2200 rpm.

The nonmagnetic cylinder 3 has a thickness of 1 mm, an outer diameter of 40, having a polyimide film with a thickness of 200 μm provided with the electrodes 4 by the etching treatment with an electrode, width of 0.5 mm and an electrode interval of 0.25 mm at the position opposed to the image holding member 5 adhered onto the outer surface of the nonmagnetic cylinder. Application voltage onto the above electrodes 4 is 40 V. By conveying the image holding member 5 at a speed of 220 mm/sec. under such conditions, the display function was examined. The results are shown in Table 1. According to the method as in Example 1, the surface roughness of the satin roller was varied variously to prepare rollers with various surface roughness (0.1 to 5 μm) to provide Examples 2, 3, 4 and 5, and further those with surface roughness of 0.05 μm and 5.5 μm are shown as Comparative examples 1 and 2. Also, for clarifying further the effect, one having no dielectric layer provided in Example 1 was made Comparative example 3.

TABLE 1

| | | Film thickness | | | | Surface roughness** | |
|---|---|---|---|---|---|---|---|
| Reference No. | Whiteness | Diffusion reflection layer | Dielectric layer | Environment | Resistivity*** | Diffusion reflection layer | Dielectric layer |
| Example 1 | 96 | 30 μm | 1 μm | 25° C./50% RH | $5 \times 10^{13}$ Ωcm | 1.5 μm | 1.2 μm |
| Example 2 | 96 | 30 | 1 | " | $5 \times 10^{13}$ Ωcm | 0.15 | 0.1 |
| Example 3 | 96 | 30 | 1 | " | $5 \times 10^{13}$ Ωcm | 0.5 | 0.4 |
| Example 4 | 96 | 30 | 1 | " | $5 \times 10^{13}$ 1Ωcm | 4 | 3.5 |
| Example 5 | 96 | 30 | 1 | " | $5 \times 10^{13}$ Ωcm | 5.5 | 5 |
| Comparative Example 1 | 96 | 30 | 1 | " | $5 \times 10^{13}$ Ωcm | 0.05 | 0.05 |
| Comparative Example 2 | 96 | 30 | 1 | " | $5 \times 10^{13}$ Ωcm | 6 | 5.5 |
| Comparative Example 3 | 96 | 30 none | " | $1 \times 10^9$ Ωcm | 1.5 | — | |

| | Initial stage | | | After successive copying* | | |
|---|---|---|---|---|---|---|
| Reference No. | Contrast | Nondisplay portion whiteness | Display portion whiteness | Contrast | Nondisplay portion whiteness | Display portion whiteness |
| Example 1 | 96 | 96 | 0 | 93 | 93 | 0 |
| Example 2 | 96 | 96 | 0 | 91 | 91 | 0 |
| Example 3 | 96 | 96 | 0 | 93 | 93 | 0 |
| Example 4 | 96 | 96 | 0 | 93 | 93 | 0 |
| EXample 5 | 96 | 96 | 0 | 91 | 91 | 0 |
| Comparative example 1 | 96 | 96 | 0 | 79 | 79 | 0 |
| Comparative example 2 | 96 | 96 | 0 | 69 | 69 | 0 |
| Comparative example 3 | 26 | 96 | 0 | 0 | 50 | 50 |

*After successive copying; after 10000 repeated display
**Surface roughness: 10 point average roughness Rz

***Resistivity ρ: $\rho = \frac{RS}{t}$, S: measured area,
t: film thickness (diffusion reflection layer thickness) plus (dielectric layer thickness

EXAMPLE 6

In this Example, the image holding member 5 was formed by vapor depositing aluminum with a film thickness of 800Å onto the surface of a polyester film with a thickness of 100 μm, coating a coating material to a thickness of 30 μm according to the coating step shown below to form a diffusion reflection layer *6a* with a surface roughness of 1.5 μm. Coating of the coating material was performed by dispersing 54 parts by weight of the reducing type electroconductive zinc oxide powder with an average particle size of 1.0 μm and 30 parts by weight of a thermosetting phenol resin together with 700 parts by weight of methanol for 10 hours, coating the resulting solution with a dispersed average particle size of 1.5 μm by a reverse roll coater, followed by curing at 140° C. for 5 minutes. The resistivity of the diffusion reflection layer 6a was found to be $1\times10^9$ Ω·cm (25° C./50% RH).

Next, a coating material with a viscosity of 30 cps comprising 10 wt. % of a soluble vinyl chloride resin (number average molecular weight $4\times10^4$) and 90 wt. % of methyl ethyl ketone was coated by a reverse roll coater under the conditions of a coating speed of 4 m/min. and a gap of 10 μm, dried at 140° C. for 5 minutes to provide a dielectric layer 6b on the previous diffusion reflection layer 6a of white film, thus preparing an image holding member 5 with a surface roughness of 1.2 μm.

By controlling the coating conditions for the dielectric layer 6b, Examples 7, 8 with different surface roughness (0.4 μm, 0.1 μm) were prepared. Together with these Examples and Comparative example 4, the display characteristics of the image holding member 5 are shown in Table 2.

TABLE 2

| Reference No. | Whiteness | Film thickness: Diffusion reflection layer | Film thickness: Dielectric layer | Environment | Resistivity*** | Surface roughness**: Diffusion reflection layer | Surface roughness**: Dielectric layer |
|---|---|---|---|---|---|---|---|
| Example 6 | 94 | 30 μm | 1 μm | 25° C./50% RH | $1\times10^{13}$ Ωcm | 1.5 μm | 1.2 μm |
| | 94 | " | " | 15° C./10% RH | $1\times10^{14}$ Ωcm | " | " |
| | 94 | " | " | 35° C./85% RH | $1\times10^{12}$ Ωcm | " | " |
| Example 7 | 94 | 30 μm | 2 μm | | $1\times10^{13}$ Ωcm | 1.5 μm | 0.4 μm |
| Example 8 | 94 | 30 μm | 3 μm | | $1\times10^{13}$ Ωcm | 1.5 μm | 0.1 μm |
| Comparative Example 4 | 94 | 4 μm | 4 μm | | $1\times10^{13}$ Ωcm | 1.5 μm | 0.05 μm |

| Reference No. | Initial stage: Contrast | Initial stage: Nondisplay portion whiteness | Initial stage: Display portion whiteness | After successive copying*: Contrast | After successive copying*: Nondisplay portion whiteness | After successive copying*: Display portion whiteness |
|---|---|---|---|---|---|---|
| Example 6 | 94 | 94 | 0 | 91 | 91 | 0 |
| | 94 | 94 | 0 | 91 | 91 | 0 |
| | 94 | 94 | 0 | 91 | 91 | 0 |
| Example 7 | 94 | 94 | 0 | 91 | 91 | 0 |
| Example 8 | 94 | 94 | 0 | 89 | 89 | 0 |
| Comparative example 4 | 94 | 94 | 0 | 77 | 77 | 0 |

*After successive copying; after 10000 repeated display
**Surface roughness: 10 point average roughness Rz
***Resistivity ρ: $\rho = \frac{RS}{t}$, S: measured area,
t: film thickness (diffusion layer thickness) plus (dielectric layer thickness Also, in Example 6, by changing the composition ratio of the reducing type electroconductive zinc oxide used for the diffusion reflection layer 6a as shown in Table 3, Examples 9–11 and Comparative examples 5, 6 with different resistivities of diffusion reflection layers were prepared, and their display characteristics are shown in Table 4.

TABLE 3

| | Reducing type electroconductive zinc oxide powder | Thermosetting phenol resin | Diffusion reflection layer inherent electric resistance |
|---|---|---|---|
| Example 9 | 120 parts by weight | 30 parts by weight | $1\times10^7$ Ω · cm |
| Example 10 | 90 parts by weight | " | $1\times10^8$ Ω · cm |
| Example 11 | 30 parts by weight | " | $1\times10^{12}$ Ω · cm |
| Comparative example 5 | 15 parts by weight | " | $1\times10^{13}$ Ω · cm |
| Comparative example 6 | 10 parts by weight | " | $1\times10^{14}$ Ω · cm |

TABLE 4

| Reference No. | Whiteness | Film thickness: Diffusion reflection layer | Film thickness: Dielectric layer | Environment | Resistivity*** | Surface roughness**: Diffusion reflection layer | Surface roughness**: Dielectric layer |
|---|---|---|---|---|---|---|---|
| Example 9 | 94 | 30 μm | 1 μm | 25° C./50% RH | $1\times10^{13}$ Ωcm | 1.5 μm | 1.2 μm |
| Example 10 | 94 | 30 | 1 | " | $1\times10^{13}$ Ωcm | 1.5 | 1.2 |
| Example 11 | 94 | 30 | 1 | " | $1\times10^{13}$ Ωcm | 1.5 | 1.2 |
| Comparative Example 5 | 94 | 30 | 1 | " | $2\times10^{13}$ Ωcm | 1.5 | 1.2 |
| Comparative Example 6 | 94 | 30 | 1 | " | $2\times10^{13}$ Ωcm | 1.5 | 1.2 |

| | Initial stage | After successive copying* |
|---|---|---|

TABLE 4-continued

| Reference No. | Contrast | Nondisplay portion whiteness | Display portion whiteness | Contrast | Nondisplay portion whiteness | Display portion whitenessptz,1/54 |
|---|---|---|---|---|---|---|
| Example 9 | 94 | 94 | 0 | 91 | 91 | 0 |
| Example 10 | 94 | 94 | 0 | 91 | 91 | 0 |
| Example 11 | 94 | 94 | 10 | 81 | 91 | 10 |
| Comparative example 5 | 94 | 94 | 40 | 51 | 91 | 40 |
| Comparative example 6 | 94 | 94 | 60 | 31 | 91 | 60 |

*After successive copying; after 10000 repeated display
**Surface roughness: 10 point average roughness Rz
***Resistivity $\rho$: $\rho = \frac{RS}{t}$, S: measured area,
t: film thickness (diffusion reflection layer thickness) plus (dielectric layer thickness

EXAMPLE 12

In this Example, the image holding member 5 was formed by vapor depositing aluminum with a film thickness of 800Å onto the surface of a polyester film with a thickness of 100 μm, coating a coating material to a thickness of 30 μm according to the coating step shown below to form a diffusion reflection layer 6a with a surface roughness of 1.5 μm. That is, coating of the coating material was performed by dispersing 54 parts by weight of antimony oxide powder with an average particle size of 1.0 μm and 30 parts by weight of a thermosetting phenol resin together with 700 parts by weight of methanol for 10 hours, coating the resulting solution with a dispersed average particle size of 1.5 μm by a reverse roll coater, followed by curing at 140° C. for 5 minutes. The resistivity of the diffusion reflection layer was found to be $1\times10^8$ •cm (25° C./50% RH).

Next, a coating material with a viscosity of 30 cps comprising 10 wt. % of a soluble acrylic resin (number average molecular weight $4\times10^4$) and 90 wt. % of methyl ethyl ketone was coated by a reverse roll coater under the conditions of a coating speed of 4 m/min. and a gap of 10 μm, dried at 140° C. for 5 minutes to provide a dielectric layer with a film thickness of 1 μm on the previous diffusion reflection layer of white film, thus preparing an image holding member with a surface roughness of 1.2 μm. One using a soluble type vinyl alcohol resin as the resin for the dielectric layer 6b was made Example 12, while those using soluble vinyl pyridine resin, soluble polyacrylic quaternary amine resin were made Comparative examples 7 and 8, of which characteristics as the respective image holding members when formed into image holding members by coating similarly as in Example 12 are shown in Table 5.

TABLE 5

| Reference No. | Whiteness | Film thickness: Diffusion reflection layer | Film thickness: Dielectric layer | Environment | Surface roughness**: Resistivity*** | Surface roughness**: Diffusion reflection layer | Surface roughness**: Dielectric layer |
|---|---|---|---|---|---|---|---|
| Example 12 | 93 | 30 μm | 1 μm | 25° C./50% RH | $1\times10^{14}$ Ωcm | 1.5 μm | 1.2 μm |
| Example 13 | 93 | 30 | 1 | " | $1\times10^{12}$ Ωcm | 1.5 | 1.2 |
| Comparative Example 7 | 93 | 30 | 1 | " | $5\times10^{10}$ Ωcm | 1.5 | 1.2 |
| Comparative | 93 | 30 | 1 | " | $5\times10^{8}$ Ωcm | 1.5 | 1.2 |

| Reference No. | Initial stage: Contrast | Initial stage: Nondisplay portion whiteness | Initial stage: Display portion whiteness | After successive copying*: Contrast | After successive copying*: Nondisplay portion whiteness | After successive copying*: Display portion whioteness |
|---|---|---|---|---|---|---|
| Example 12 | 93 | 93 | 0 | 90 | 90 | 0 |
| Example 13 | 88 | 93 | 5 | 85 | 90 | 5 |
| Comparative Example 7 | 58 | 93 | 35 | 55 | 90 | 35 |
| Comparative Example 8 | 23 | 93 | 70 | 20 | 90 | 70 |

*After successive copying; after 10000 repeated display
**Surface roughness: 10 point average roughnes Rz
***Resistivity $\rho$: $\rho = \frac{RS}{t}$, S: measured area,
t: thickness (diffusion reflection layer thickness) plus (dielectric layer thickness As is apparent from the above Examples, according to the present Examples, excellent contrast, recording or display characteristics, repetition characteristics and environmental stability can be obtained.

Figure 4:
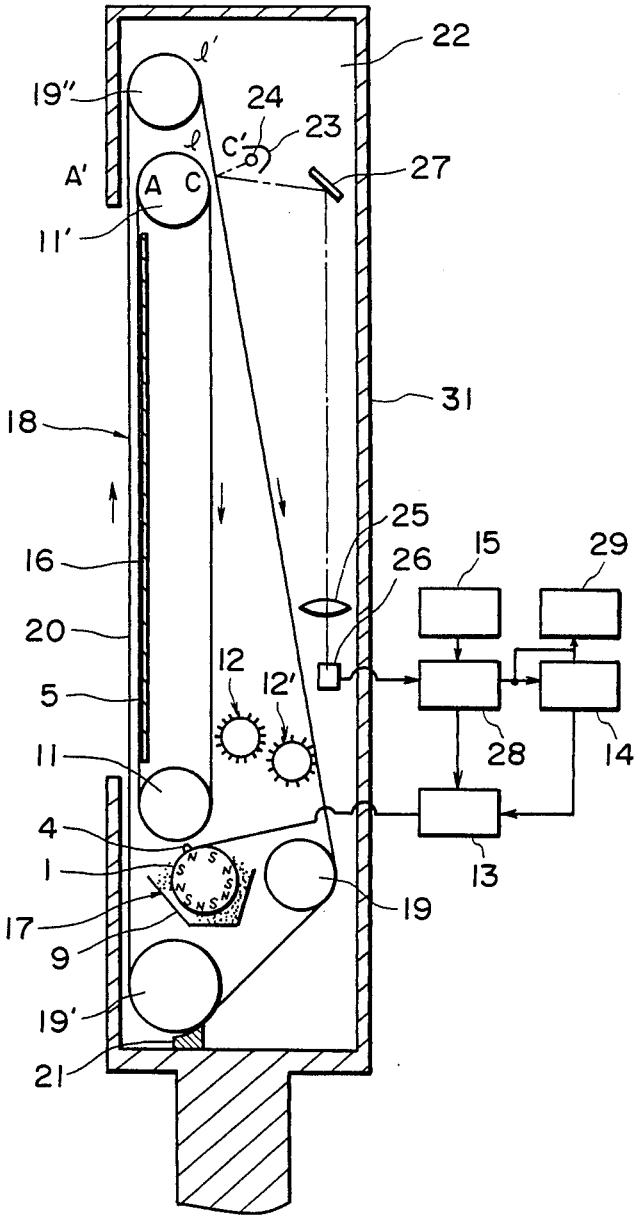
FIG. 4 is a whole longitudinal sectional view of the recording display device according to another example of the present invention.
Figure 5:
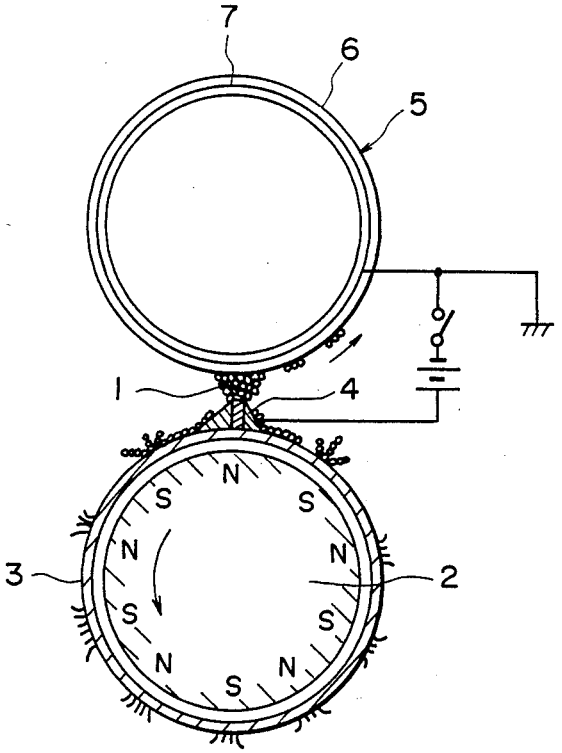
FIG. 5 is a diagram showing the principle of the recording display device of the prior art.

The present invention is not limited to the above Examples, but can be practiced with various modifications within the spirit of the invention. For example, as an example, by equipping the recording device shown in FIG. 3 with the writing display function, the reading function and the printing function, a recording display device shown in FIG. 4 can be prepared.

The image information to be displayed is inputted from the manuscript reading device 15, and through the symbolized composite circuit 28 and the memorizing device 14, or directly from the symbolized composite circuit 28, applied by the recording control section 13 as electrical signals on the recording electrode 4.

Also, on the outer peripheral side of the above image holding member 1, is arranged a writing medium 20 which is formed in the shape of an endless belt, transparent and writable as well as erasable with a felt pen, etc., and the writing medium 20 is hanged circulatably over the rollers 19, 19' and 19'', and supported in flat shape by the rollers 19, 19' at the display portion. Also, in the vicinity of the roller 11 are provided cleaning members 12, 12' for removing the magnetic electroconductive developer attached on the image on the image holding member 5 and the back surface of the writing medium 20.

The cleaning members 12, 12' remove the magnetic electroconductive developer by rotating in the shape of a brush the magnet brush of the toner formed by magnetic attracting force on the outer periphery of the cylindrical members. At the lower side of the roller 19' is arranged an erasing member 21 for erasing the image written on the writing medium 20.

Further, on the backside of the image holding member 5 is arranged a reading means 22 for reading images on the image holding member and the writing medium 20. More specifically, at the reading position which is the nearest position between the image holding member 5 and the writing medium 20 are arranged a lamp 24 equipped with a reflection hood 23 for irradiating the images on both members 5, 20, and a mirror 27 for permitting the reflected light images from the both members 5, 20 to enter photoelectric converting element 26 through the lens 25.

The images on the above image holding member 5 and the writing medium 20 are read by the photoelectric converting element 26 and recorded through the symbolized composite circuit 28, directly or through the memorizing device 14 on the printer 29.

According to the Examples as described above, the diffusion reflection layer having reflective fine particles dispersed in a resin can remove inner cracks, etc., and therefore can effect alleviation of trapping of the magnetic electroconductive developer by the uneven surface, whereby leak of voltage can be prevented.

Also, since reflective fine particles are dispersed in a resin, whiteness is improved due to the synergetic effect with the interface reflection from the refractive index difference at such interface to improve contrast. Further, by providing a dielectric layer on the diffusion reflection layer, fine unevenness due to reflective fine particles remaining on the diffusion reflection layer surface as well as fine voids internally formed can be removed.

As a consequence, penetration of the magnetic electroconductive developer into fine voids during repeated uses, and lowering in contrast during repeated uses by securing of fine unevenness on the surface, and further lowering in electrical resistance due to adsorption of water through fine voids at high humidity can be avoided, whereby contrast lowering at high humidity can be markedly prevented.

Also, when the dielectric layer of the image holding member directly contacts the magnetic electroconductive developer, charges are injected from the magnetic electroconductive developer during voltage application to result in generation of charges in the dielectric layer. If at this time the electrical resistance of the diffusion reflection layer constituting the image holding member is greater than that of the dielectric layer, charge decay at the diffusion reflection layer becomes slower than that in the dielectric layer, whereby the charges injected into the dielectric layer will reside at the interface with the diffusion reflection layer to give extremely poor efficiency of deelectrification and a potential remaining internally, which may cause ghost or contrast lowering during repetition.

In the present invention, since the electrical resistance of the diffusion resistance layer is smaller than that of the dielectric layer, the charges in the diffusion reflectiOn layer will be quickly decayed. As the result, it becomes possible to discharge quickly the charges remaining internally of the dielectric layer through the diffusion reflection layer to the substrate side, which is very advantageous in decay of residual charges and effective for removing ghost, preventing contrast lowering during repetition.

Also, if the surface roughness of the dielectric layer is 0.1 μm or less, the surface becomes too smooth, and the dielectric layer directly contacts the magnetic electroconductive developer and charges are injected from the magnetic electroconductive developer, with the result that the electrical field is liable to remain internally of the dielectric layer, thereby causing readily ghost or contrast lowering to occur. On the other hand, if the surface roughness of the dielectric layer is 5 μm or more, the magnetic electroconductive developer is trapped by the unevenness of the surface to be secured on the surface, thus bringing about lowering in contrast.

Accordingly, in the present invention, by setting the surface roughness in the range of 0.1 to 5 μm, highly insulating void is formed between the dielectric layer and the magnetic electroconductive developer to inhibit charge injection into the dielectric layer, and also the developer will not be trapped by the fine unevenness on the surface.

Table 6 shows Examples 14, 15, 16, 17 and 18 with different surface roughnesses (0.1 to 5 μm) prepared by varying the surface roughness of the satin-embossed roller according to the same method as in Example 1, and further Comparative examples 9 and 10 with surface roughnesses of 0.05 μm and 5.5 μm. Also, for making the effect clearer, one having no dielectric layer provided in Example 14 was made Comparative example 11.

Table 7 shows additionally Examples 19, 20, 21 and Comparative example 12 prepared according to the same method as in Example 1 except for slight change conditions, namely with changes in film thickness of the diffusion reflection layer. Also, for making the effect clearer, one having no dielectric layer provided in Example 19 was made Comparative example 13.

TABLE 6

| | | Film thickness | | | | Surface roughness** | |
|---|---|---|---|---|---|---|---|
| Reference No. | Whiteness | Diffusion reflection layer | Dielectric layer | Environment | Resistivity*** | Diffusion reflection layer | Dielectric layer |
| Example 14 | 87 | 6 μm | 1 μm | 25° C./50% RH | $5 \times 10^{13}$ Ωcm | 1.5 μm | 1.2 μm |
| Example 15 | 87 | 6 μm | 1 μm | " | $5 \times 10^{13}$ | 0.15 | 0.1 |
| Example 16 | 87 | 6 μm | 1 μm | " | $5 \times 10^{13}$ | 0.5 | 0.4 |
| Example 17 | 87 | 6 μm | 1 μm | " | $5 \times 10^{13}$ | 4 | 3.5 |
| Example 18 | 87 | 6 μm | 1 μm | " | $5 \times 10^{13}$ | 5.5 | 5 |
| Comparative Example 9 | 87 | 6 μm | 1 μm | " | $5 \times 10^{13}$ | 0.05 | 0.05 |
| Comparative Example 10 | 87 | 6 μm | 1 μm | " | $5 \times 10^{13}$ | 6 | 5.5 |

TABLE 6-continued

| | | | | | | | |
|---|---|---|---|---|---|---|---|
| Comparative Example 11 | 87 | 6 μm | none | " | $5 \times 10^{13}$ | 1.5 | — |

| | Initial stage | | | After successive copying* | | |
|---|---|---|---|---|---|---|
| Reference No. | Contrast | Nondisplay portion whiteness | Display portion whiteness | Contrast | Nondisplay portion whiteness | Display portion whiteness |
| Example 14 | 87 | 87 | 0 | 84 | 84 | 0 |
| Example 15 | 87 | 87 | 0 | 82 | 82 | 0 |
| Example 16 | 87 | 87 | 0 | 84 | 84 | 0 |
| Example 17 | 87 | 87 | 0 | 84 | 84 | 0 |
| Example 18 | 87 | 87 | 0 | 82 | 82 | 0 |
| Comparative example 9 | 87 | 87 | 0 | 70 | 70 | 0 |
| Comparative example 10 | 87 | 87 | 0 | 60 | 60 | 0 |
| Comparative example 11 | 87 | 87 | 0 | 30 | 30 | 0 |

*After successive copying; after 10000 repeated display
**Surface roughness: 10 point average roughness Rz
***Resistivity
$\rho$: $\rho = \frac{RS}{t}$,
S: measured area,
t: film thickness (diffusion reflection layer thickness) plus (dielectric layer thickness)

TABLE 7

| | | Film thickness | | | |
|---|---|---|---|---|---|
| Reference No. | White-ness | Diffusion reflection layer | Dielectric layer | Environment | Resistivity*** |
| Example 19 | 86 | 10 μm | 1 μm | 25° C./50% RH | $1 \times 10^{13}$ Ωcm |
| | | | | 15° C./10% RH | $1 \times 10^{14}$ |
| | | | | 35° C./85% RH | $1 \times 10^{12}$ |
| Example 20 | 92 | 20 | 1 | 25° C./50% RH | $1 \times 10^{13}$ |
| Example 21 | 96 | 30 | 1 | 25° C./50% RH | $1 \times 10^{13}$ |
| Comparative Example 12 | 65 | 2 | 1 | 25° C./50% RH | $1 \times 10^{13}$ |
| Comparative Example 13 | 65 | 2 | | 25° C./50% RH | $1 \times 10^{9}$ |
| | | | | 15° C./10% RH | $1 \times 10^{10}$ |
| | | | | 35° C./85% RH | $1 \times 10^{8}$ |

| | Initial stage | | | After successive copying* | | |
|---|---|---|---|---|---|---|
| Reference No. | Contrast | Nondisplay portion whiteness | Display portion whiteness | Contrast | Nondisplay portion whiteness | Display portion whiteness |
| Example 19 | 86 | 86 | 0 | 81 | 81 | 0 |
| | 86 | 86 | 0 | 81 | 81 | 0 |
| | 86 | 86 | 0 | 81 | 81 | 0 |
| Example 20 | 92 | 92 | 0 | 87 | 87 | 0 |
| Example 21 | 96 | 96 | 0 | 91 | 91 | 0 |
| Comparative Example 12 | 65 | 65 | 0 | 60 | 60 | 0 |
| Comparative | 5 | 65 | 60 | 0 | 35 | 35 |
| Example 13 | 5 | 65 | 60 | 0 | 35 | 35 |
| | 5 | 65 | 60 | 0 | 35 | 35 |

*After succesive copying; after 10000 repeated display
***Resistivity
$\rho$: $\rho = \frac{RS}{t}$,
S: measured area,
t: film thickness (diffusion reflection layer thickness) plus (dielectric layer thickness)

EXAMPLE 22

In this Example, the image holding member 5 was formed by vapor depositing aluminum with a film thickness of 800Å onto the surface of a polyester film with a thickness of 100 μm, applying a coating material to a thickness of 30 μm according to the coating step shown below to form a coating as the diffusion reflection layer with a surface roughness of 1.5 μm. More specifically, coating of the coating material was performed by dispersing 54 parts by weight of barium sulfate powder with an average particle size of 1.0 μm and 30 parts by weight of a thermosetting phenol resin together with 810 parts by weight of methanol in a ball mill for 10 hours, coating the resulting dispersion with an average dispersed particle size of 1.5 μm by a reverse roll coater, followed by heating at 140° C. for 5 minutes.

Next, a coating material with a viscosity of 30 cps comprising 10 wt. % of a soluble acrylic resin (number average mOlecular weight $4 \times 10^4$) and 90 wt. % of methyl ethyl ketone was coated by a reverse roll coater under the conditions of a coating speed of 4 m/min. and a gap of 10 μm and dried at 140° C. for 5 minutes to provide a dielectric layer with a film thickness of 1 μm on the previous white film of the diffusion reflection layer, thus preparing an image holding member 5 having a surface roughness of 1.2 μm.

Table 8 shows the recording and displaying characteristics of the image holding member 5 in Examples and Comparative examples with different surface roughnesses of the dielectric layer 6b prepared by controlling the coating conditions of the dielectric layer 6b and also in the case when no dielectric layer was provided.

TABLE 8

| Reference No. | Whiteness | Film thickness: Diffusion reflection layer | Film thickness: Dielectric layer | Environment | Resistivity*** | Surface roughness**: Diffusion reflection layer | Surface roughness**: Dielectric layer |
|---|---|---|---|---|---|---|---|
| Example 22 | 70 | 4 μm | 1 μm | 25° C./ 50% RH | $5 \times 10^{13}$ Ωcm | 1.5 μm | 1.2 μm |
| | " | " | " | 15° C./10% RH | $5 \times 10^{14}$ Ωcm | " | " |
| | " | " | " | 35° C./85% RH | $5 \times 10^{12}$ Ωcm | " | " |
| Comparative Example 14 | 70 | 4 μm | 3 μm | 25° C./50% RH | $5 \times 10^{13}$ Ωcm | 1.5 μm | 0.05 μm |
| | " | " | " | 15° C./10% RH | $5 \times 10^{14}$ Ωcm | " | " |
| | " | " | " | 35° C./85% RH | $5 \times 10^{12}$ Ωcm | " | " |
| Comparative Example 15 | 70 | 4 μm | none | 25° C./50% RH | $5 \times 10^{13}$ Ωcm | 1.5 μm | — |
| | " | " | " | 15° C./10% RH | $5 \times 10^{14}$ Ωcm | " | — |
| | " | " | " | 35° C./85% RH | $2 \times 10^{11}$ Ωcm | " | — |

| Reference No. | Initial stage: Contrast | Initial stage: Nondisplay portion whiteness | Initial stage: Display portion whiteness | After successive copying*: Contrast | After successive copying*: Nondisplay portion whiteness | After successive copying*: Display portion whiteness |
|---|---|---|---|---|---|---|
| Example 22 | 70 | 70 | 0 | 67 | 67 | 0 |
| | 70 | 70 | 0 | 67 | 67 | 0 |
| | 70 | 70 | 0 | 67 | 67 | 0 |
| Comparative example 14 | 70 | 70 | 0 | 53 | 53 | 0 |
| | 70 | 70 | 0 | 45 | 45 | 0 |
| | 70 | 70 | 0 | 53 | 53 | 0 |
| Comparative example 15 | 70 | 70 | 0 | 50 | 50 | 0 |
| | 70 | 70 | 0 | 50 | 50 | 0 |
| | 70 | 70 | 0 | 0 | 50 | 50 |

*After successive copying; after 10000 repeated display
**Surface roughness: 10 point average roughness Rz
***Resistivity
$\rho$: $\rho = \frac{RS}{t}$,
S: measured area,
t: film thickness (diffusion reflection layer thickness) plus (dielectric layer thickness)

EXAMPLE 23

In this Example, the image holding member 5 was formed by vapor depositing aluminum with a film thickness of 800Å onto the surface of a polyester film with a thickness of 100 μm, applying a coating material to a thickness of 30 μm according to the coating step shown below to form a coating as the diffusion reflection layer 6a with a surface roughness of 1.5 μm. More specifically, coating of the coating material has performed by dispersing 54 parts by weight of barium sulfate powder with an average particle size of 1.0 μm and 30 parts by weight of a thermosetting phenol resin together with 810 parts by weight of methanol in a ball mill for 10 hours, coating the resulting dispersion with an average dispersed particle size of 1.5 μm by a reverse roll coater, followed by heating at 140° C. for 5 minutes.

Next, a coating material with a viscosity of 30 cps comprising 10 wt. % of a soluble vinyl chloridevinyl acetate resin (number average molecular weight $4 \times 10^4$) and 90 wt. % of methyl ethyl ketone was coated by a reverse roll coater under the conditions of a coating speed of 4 m/min. and a gap of 10 μm and dried at 140° C. for 5 minutes to provide a dielectric layer with a film thickness of 1 μm on the previous white film of the diffusion reflection layer 6a, thus preparing an image holding member 5 having a surface roughness of 1.2 μm.

Table 9 shows the recording and displaying characteristics of the image holding member 5 together with those in Examples 24, 25 and Comparative example 16 with different surface roughnesses (0.4 μm, 0.1 μm) of the dielectric layer 6b prepared by controlling the coating conditions of the dielectric layer 6b.

TABLE 9

| Reference No. | Whiteness | Film thickness: Diffusion reflection layer | Film thickness: Dielectric layer | Environment | Resistivity*** | Surface roughness**: Diffusion reflection layer | Surface roughness**: Dielectric layer |
|---|---|---|---|---|---|---|---|
| Example 23 | 70 | 4 μm | 1 μm | 25° C./50% RH | $5 \times 10^{13}$ Ωcm | 1.5 μm | 1.2 μm |
| Example 24 | 70 | 4 μm | 2 μm | " | $5 \times 10^{13}$ Ωcm | 1.5 μm | 0.4 μm |
| Example 25 | 70 | 4 μm | 3 μm | " | $5 \times 10^{13}$ Ωcm | 1.5 μm | 0.1 μm |
| Comparative Example 16 | 70 | 4 μm | 4 μm | " | $5 \times 10^{13}$ Ωcm | 1.5 μm | 0.05 μm |

| Reference No. | Initial stage: Contrast | Initial stage: Nondisplay portion whiteness | Initial stage: Display portion whiteness | After successive copying*: Contrast | After successive copying*: Nondisplay portion whiteness | After successive copying*: Display portion whiteness |
|---|---|---|---|---|---|---|
| Example 23 | 70 | 70 | 0 | 67 | 67 | 0 |
| Example 24 | 70 | 70 | 0 | 67 | 67 | 0 |
| Example 25 | 70 | 70 | 0 | 65 | 65 | 0 |
| Comparative | 70 | 70 | 0 | 53 | 53 | 0 |

TABLE 9-continued example 16

*After successive copying; after 10000 repeated display
**Surface roughness: 10 point average roughness Rz
***Resistivity
$\rho$: $\rho = \frac{RS}{t}$,
S: measured area,
t: film thickness (diffusion reflection layer thickness) plus (dielectric layer thickness)

EXAMPLE 26

In this Example, the image holding member 5 was formed by vapor depositing aluminum with a film thickness of 800Å onto the surface of a polyester film with a thickness of 100 μm, applying a coating material to a thickness of 30 μm according to the coating step shown below to form a coating as the diffusion reflection layer 6a with a surface roughness of 1.5 μm. More specifically, coating of the coating material was performed by dispersing 54 parts by weight of the reducing type electroconductive zinc oxide powder with an average particle size of 1.0 μm and 30 parts by weight of a thermosetting phenol resin together with 700 parts by weight of methyl ethyl ketone in a ball mill for 10 hours, coating the resulting dispersion with an average dispersed particle size of 1.2 μm by a reverse roll coater, followed by heating at 140° C. for 5 minutes. The diffusion reflection layer 6a was found to have a resistivity of $1\times10^9$ Ω·cm (25° C./50% RH).

Next, a coating material with a viscosity of 30 cps comprising 10 wt. % Of a soluble vinyl chloride-vinyl acetate resin (number average molecular weight $4\times10^4$) and 90 wt. % of methyl ethyl ketone was coated by a reverse roll coater under the conditions of a coating speed of 4 m/min. and a gap of 10 μm and dried at 140° C. for 5 minutes to provide a dielectric layer 6b with a film thickness of 1 μm on the previous white film of the diffusion reflection layer 6a, thus preparing an image holding member 5 having a surface roughness of 1.2 μm.

Table 10 shows the recording and displaying characteristics of the image holding member 5 together with those in Examples and Comparative examples with thicker film thicknesses of the dielectric layer 6b prepared by controlling the coating conditions of the dielectric layer.

Also, Table 10 shows the recording and displaying characteristics of Examples and Comparative examples with different resistivities of the diffusion reflection layer 6a prepared by varying the composition ratio (see Table 11) of the reducing type electroconductive zinc oxide used in the diffusion reflection layer 6a in Example 26.

TABLE 10

| Reference No. | Whiteness | Film thickness: Diffusion reflection layer | Film thickness: Dielectric layer | Environment | Resistivity*** |
|---|---|---|---|---|---|
| Example 26 | 94 | 30 μm | 1 μm | 25° C./50% RH | $1\times10^{13}$ Ωcm |
| | " | " | " | 15° C./10% RH | $1\times10^{14}$ Ωcm |
| | " | " | " | 35° C./85% RH | $1\times10^{12}$ Ωcm |
| Example 27 | 94 | 30 | 3 | 25° C./50% RH | $1\times10^{13}$ Ωcm |
| Example 28 | 94 | 30 | 5 | 25° C./50% RH | $1\times10^{13}$ Ωcm |
| Example 29 | 94 | 30 | 7 | 25° C./50% RH | $1\times10^{13}$ Ωcm |
| Comparative Example 17 | 94 | 30 | 10 | 25° C./50% RH | $1\times10^{13}$ Ωcm |

| Refrence No. | Initial stage: Contrast | Initial stage: Nondisplay portion whiteness | Initial stage: Display portion whiteness | After successive copying*: Contrast | After successive copying*: Nondisplay portion whiteness | After successive copying*: Display portion whiteness |
|---|---|---|---|---|---|---|
| Example 26 | 94 | 94 | 0 | 89 | 89 | 0 |
| | 94 | 94 | 0 | 89 | 89 | 0 |
| | 94 | 94 | 0 | 89 | 89 | 0 |
| Example 27 | 94 | 94 | 0 | 89 | 89 | 0 |
| Example 28 | 94 | 94 | 0 | 89 | 89 | 0 |
| Example 29 | 89 | 94 | 5 | 74 | 89 | 5 |
| Comparative example 17 | 64 | 94 | 30 | 59 | 89 | 30 |

*After successive copying; after 10000 repeated display
***Resistivity $\rho$: $\rho = \frac{RS}{t}$,
S: measured area,
t: film thickness (diffusion reflection layer thickness) plus (dielectric layer thickness)

TABLE 11

| | Composition: Reducing type electroconductive zinc oxide powder | Composition: Thermosetting phenol resin | Diffusion reflection layer: Inherent electric resistivity |
|---|---|---|---|
| Example 30 | 120 parts by weight | 30 | $1\times10^7$ Ω · cm |
| Example 31 | 90 parts by weight | 30 | $1\times10^8$ Ω · cm |
| Example 32 | 30 parts by weight | 30 | $1\times10^{12}$ Ω · cm |
| Comparative example 18 | 15 parts by weight | 30 | $1\times10^{13}$ Ω · cm |
| Comparative example 19 | 10 parts by weight | 30 | $1\times10^{14}$ Ω · cm |

TABLE 12

| Reference No. | Film thickness: Whiteness | Diffusion reflection layer | Dielectric layer | Environment | Resistivity*** |
|---|---|---|---|---|---|
| Example 33 | 94 | 30 μm | 1 μm | 25° C./50% RH | $1 \times 10^{13}$ Ωcm |
| Example 34 | 94 | 30 | 1 | 25° C./50% RH | $1 \times 10^{13}$ Ωcm |
| Example 35 | 94 | 30 | 1 | 25° C./50% RH | $1 \times 10^{13}$ Ωcm |
| Comparative Example 20 | 94 | 30 | 1 | 25° C./50% RH | $2 \times 10^{13}$ Ωcm |
| Comparative Example 21 | 94 | 30 | 1 | 25° C./50% RH | $2 \times 10^{13}$ Ωcm |

| Reference No. | Initial stage: Contrast | Nondisplay portion whiteness | Display portion whiteness | After successive copying*: Contrast | Nondisplay portion whiteness | Display portion whiteness |
|---|---|---|---|---|---|---|
| Example 33 | 94 | 94 | 0 | 89 | 89 | 0 |
| Example 34 | 94 | 94 | 0 | 89 | 89 | 0 |
| Example 35 | 84 | 94 | 0 | 79 | 89 | 10 |
| Comparative example 20 | 54 | 94 | 40 | 49 | 89 | 40 |
| Comparative example 21 | 34 | 94 | 60 | 29 | 89 | 60 |

*After successive copying; after 10000 repeated display

***Resistivity ρ: $\rho = \frac{RS}{t}$,

S: measured area, t: film thickness (diffusion reflection layer thickness) plus (dielectric layer thickness)

EXAMPLE 36

On the surface of a polyester film with a thickness of 100 μm, aluminum was vapor deposited with a film thin thickness of 800Å , and a coating material was applied according to the coating described below to a thickness of 30 μm to form a diffusion reflection layer 6a.

Coating 54 parts by weight of antimony oxide powder with an average particle size of 1.0 μm and 30 parts by weight of a thermosetting phenol resin together with 700 parts by weight of methyl ethyl ketone were dispersed in a ball mill for 10 hours, coating the resulting dispersion with an average dispersed particle size of 1.0 μm by a reverse roll coater, followed by heating at 140° C. for 5 minutes. The diffusion reflection layer 6a was found to have a resistivity of $1 \times 10^8$ Ω·cm (25° C./50% RH).

Next, a coating material with a viscosity of 30 cps comprising 10 wt. % of a soluble acrylic resin (number average molecular weight $4 \times 10^4$) and 90 wt. % of methyl ethyl ketone was coated by a reverse roll coater under the conditions of a coating speed of 4 m/min. and a gap of 10 μm and dried at 140° C. for 5 minutes to provide a dielectric layer 6b with a film thickness of 1 μm on the previous white film of the diffusion reflection layer 6a, thus preparing an image holding member 5.

In Example 37, Comparative examples 22, 23, the resin in the dielectric layer 6b was replaced with the soluble type vinyl alcohol resin, the soluble type vinylpyridine resin and the soluble type polyacrylic quaternary amine resin, and coated in the same manner as in Example 35 to form the image holding members 5, respectively.

The recording and displaying characteristics as the respective image holding members are shown in Table 13.

Example 37: the soluble type vinyl alcohol resin for dielectric layer;

Comparative example 22: the soluble type vinyl-pyridine resin for dielectric layer:

Comparative example 23: the soluble type polyacrylic quaternary amine resin.

TABLE 13

| Reference No. | Film thickness: Whiteness | Diffusion reflection layer | Dielectric layer | Environment | Resistivity*** |
|---|---|---|---|---|---|
| Example 36 | 93 | 30 μm | 1 μm | 25° C./50% RH | $1 \times 10^{14}$ Ωcm |
| Example 37 | 93 | 30 | 1 | 25° C./50% RH | $1 \times 10^{12}$ Ωcm |
| Comparative Example 22 | 93 | 30 | 1 | 25° C./50% RH | $2 \times 10^{11}$ Ωcm |
| Comparative Example 23 | 93 | 30 | 1 | 25° C./50% RH | $2 \times 10^{9}$ Ωcm |

| Reference No. | Initial stage: Contrast | Nondisplay portion whiteness | Display portion whiteness | After successive copying*: Contrast | Nondisplay portion whiteness | Display portion whiteness |
|---|---|---|---|---|---|---|
| Example 36 | 93 | 93 | 0 | 88 | 88 | 0 |
| Example 37 | 88 | 93 | 5 | 83 | 88 | 5 |
| Comparative example 22 | 68 | 93 | 25 | 63 | 88 | 25 |
| Comparative | 23 | 93 | 70 | 18 | 88 | 70 |

TABLE 13-continued example 23

*After successive copying; after 10000 repeated display

***Resistivity $\rho$: $\rho = \frac{RS}{t}$,

S: measured area, t: film thickness (diffusion reflection layer thickness) plus (dielectric layer thickness)

The image holding member of the present invention is not required to satisfy both of the conditions of 10-point average roughness and electrical resistance of the above dielectric layer, but either one may be satisfied. These are also apparent from the Examples of Example 14 et seq.

The present invention comprises the above constitution and action, and can form a display surface excellent in whiteness with a diffusion reflection layer and can improve contrast.

Also, by laminating a dielectric layer on the diffusion reflection layer surface, unevenness on the diffusion reflection layer surface can be removed, and also progress of water into the diffusion reflection layer can be prevented by the dielectric layer, whereby the environmental characteristics can be improved, and also durability can be improved.

Further, since the electrical resistance is made smaller than that of the dielectric layer, the charges in the diffusion reflectiOn layer can be decayed quickly to prevent contrast lowering during repeated uses, etc. and maintain good stable image quality.

Further, when the surface roughness of the dielectric layer is set within the range of 0.1 to 0.5 μm, good image quality can be maintained over a long term.

We claim:

1. An image holding member for holding granular dry process developer through electrical adsorption force, comprising from the side for holding the dry process developer:

a dielectric layer;

a diffusion reflection layer having reflective fine particles dispersed in a resin: and an electroconductive layer, said dielectric layer being made to have a ten-point average roughness of 0.1 μm to 5.0 μm.

2. An image holding member according to claim 1, wherein the ten-point average roughness of said dielectric layer is preferably 0.1 μm to 3.5 μm.

3. An image holding member according to claim 1, wherein said dielectric layer is constituted mainly of a resin and a substance for lowering electrical resistance is further added thereto.

4. An image holding member for holding granular dry process developer through electrical adsorption force, comprising from the side for holding the dry process developer:

a dielectric layer;

a diffusion reflection layer having reflective fine particles dispersed in a resin; and an electroconductive layer;

wherein said diffusion reflection layer has an electrical resistance smaller than an electrical resistance of said dielectric layer, and said dielectric layer has ten-point average roughness from 0.1 μm to 5.0 μm.

5. An image holding member according to claim 4, herein the ten-point average roughness of said dielectric layer is preferably 0.1 μm to 3.5 μm.

6. An image holding member according to claim 4, wherein said dielectric layer is comprised mainly of a resin, and a substance for lowering electrical resistance is further added thereto

7. An image holding member for holding granular dry process developer through electrical adsorption force, comprising from the side for holding the dry process developer:

a dielectric layer;

a diffusion reflection layer having reflective fine particles dispersed in a resin; and an electroconductive layer, wherein said diffusion reflection layer has an electrical resistance smaller than an electrical resistance of the dielectric layer.

8. An image holding member according to claim 7, wherein said dielectric layer is comprised mainly of a resin, and a substance for lowering electrical resistance is further added thereto.

9. An image forming device for adsorbing granular dry process developer onto an image holding member through electrical adsorption force comprising:

an image holding member comprising from a side for holding the dry process developer, a dielectric layer and a diffusion reflection layer having reflective fine particles dispersed in a resin, with said dielectric layer being made to have a ten-point average roughness of 0.1 μm to 5.0 μm;

moving means for moving said image holding member;

recording electrodes arranged in a direction crossing a moving direction of said image holding member;

means for feeding an electroconductive developer disposed between said image holding member and said recording electrodes; and means for applying signal voltages to said recording electrodes.

10. An image forming device according to claim 9, further having a display portion for dispensing the visible image formed with a developer on said image holding member.

11. An image forming device for adsorbing granular dry process developer onto an image holding member through electrical adsorption force comprising:

an image holding member comprising from a side for holding the dry process developer, a dielectric layer and a diffusion reflection layer having reflective fine particles dispersed in a resin, wherein said diffusion reflection layer has an electrical resistance smaller than that of said dielectric layer, and also said dielectric layer being made to have a ten-point average roughness of 0.1 μm to 5.0 μm;

moving means for moving said image holding member;

recording electrodes arranged in a direction crossing a moving direction of said image holding member;

means for feeding an electroconductive developer between said image holding member and said recording electrodes; and means for applying signal voltages to said recording electrodes.

12. An image forming device according to claim 11, having a display portion for displaying the visible image formed with a developer on said image holding member.

13. An image forming device for adsorbing granular dry process developer onto an image holding member through electrical adsorption force comprising:

an image holding member comprising from a side for holding the dry process developer, a dielectric layer and a diffusion reflection layer having reflective fine particles dispersed in a resin, wherein said diffusion reflection layer has an electrical resistance smaller than that of said dielectric layer, moving means for moving said image holding member;

recording electrodes arranged in a direction crossing a moving direction of said image holding member;

means for feeding an electroconductive developer between said image holding member and said recording electrodes; and means for applying signal voltages on said recording electrodes.

14. An image forming device according to claim 13, having a display portion for displaying the visible image formed with a developer on said image holding member.

* * * * *

UNITED STATES PATENT AND TRADEMARK OFFICE

CERTIFICATE OF CORRECTION

PATENT NO. : 4,943,819

DATED : July 24, 1990

INVENTOR(S) : Hitoshi Toma, et al.

It is certified that error appears in the above-identified patent and that said Letters Patent is hereby corrected as shown below:

COLUMN 1:

Line 8, "record" should read --records--, and "display" should read --displays--.

COLUMN 2:

Line 10, "works" should read --words--.

COLUMN 3:

Line 51, "is, the" should read --is desired, the--.

COLUMN 4:

Line 46, "rated, polyester," should read --rated polyester,--.

COLUMN 6:

Line 14, "$10^{13}$ to $10^{9}\Omega\cdot cm$" should read --$10^{3}$ to $10^{9}\Omega\cdot cm$--.

Line 38, "loused" should read --housed--.

COLUMN 7:

Line 1, "1 μm." should read --1 mm.--.

UNITED STATES PATENT AND TRADEMARK OFFICE

CERTIFICATE OF CORRECTION

PATENT NO. : 4,943,819

DATED : July 24, 1990

INVENTOR(S) : Hitoshi Toma, et al.

It is certified that error appears in the above-identified patent and that said Letters Patent is hereby corrected as shown below:

COLUMN 8:

Table 1, in "Example 4", "$5 \times 10^{13}$ 1Ωcm" should read

--$5 \times 10^{13}$Ωcm--, and in "Comparative Example 3" (for Film thickness), "30 none " " should read --30 none--, and

COLUMN 12:

Table 5, "Comparative " should read --Comparative Example 8--.

COLUMN 14:

Line 52, "conditions," should read --in the conditions,--.

COLUMN 21:

Line 33, "thin" should be deleted.

UNITED STATES PATENT AND TRADEMARK OFFICE

CERTIFICATE OF CORRECTION

PATENT NO. : 4,943,819

DATED : July 24, 1990

INVENTOR(S) : Hitoshi Toma, et al.

It is certified that error appears in the above-identified patent and that said Letters Patent is hereby corrected as shown below:

COLUMN 23:

Line 65, "herein" should read --wherein--.

COLUMN 24:

Line 46, "dispensing" should read --displaying--.

Signed and Sealed this

First Day of September, 1992

*Attest:*

DOUGLAS B. COMER

*Attesting Officer*

*Acting Commissioner of Patents and Trademarks*